United States Patent [19]

Brownstein

[11] Patent Number: 4,466,434

[45] Date of Patent: Aug. 21, 1984

[54] OFFSET MOUTHPIECE STRUCTURE FOR UNDERWATER BREATHING

[76] Inventor: Lois H. Brownstein, P.O. Box 302, Burtonsville, Md. 20866

[21] Appl. No.: 440,269

[22] Filed: Dec. 30, 1982

[51] Int. Cl.[3] ..... A62B 7/00

[52] U.S. Cl. ..... 128/207.14; 128/136

[58] Field of Search ..... 128/207.14, 136, 204.26, 128/201.11

[56] References Cited

U.S. PATENT DOCUMENTS

| | | | |
|---|---|---|---|
| 3,060,935 | 10/1962 | Riddell | 128/136 |
| 3,107,667 | 10/1963 | Moore | 128/136 |
| 3,814,090 | 6/1974 | Hill . | |
| 3,844,281 | 10/1974 | Shamlian | 128/207.14 |
| 3,929,548 | 12/1975 | Shamlian . | |
| 4,031,888 | 6/1977 | Walters . | |
| 4,055,895 | 11/1977 | Huge | 128/136 |
| 4,071,024 | 1/1978 | Blanc | 128/201.11 |
| 4,169,473 | 10/1979 | Samelson | 128/136 |

FOREIGN PATENT DOCUMENTS

| | | | |
|---|---|---|---|
| 157889 | 1/1964 | U.S.S.R. | 128/207.14 |

*Primary Examiner*—Henry J. Recla

*Attorney, Agent, or Firm*—Laurence R. Brown

[57] ABSTRACT

This invention solves the problem of underwater mouthpieces for breathing apparatus that the mouthpieces must be gripped by the teeth to hold them in place with the jaws in an unnatural and uncomfortable position which can result in unsafe conditions as well. Thus, the flange on the end of a breathing tube of a mouthpiece over which the lips are placed is made into two portions offset by about 40 mm (¼ inch). Thus the teeth may rest against these portions and bite down on the gripping members extending into the mouth to hold the mouthpiece firmly in place in the natural mating position of the jaws that produces a slight overbite to the teeth in the upper jaws. The mouthpiece can for example be placed on a snorkel attachment or the breathing tube of other underwater breathing apparatus and thereby be held more safely and firmly without discomfort or damage to the jaw structure.

1 Claim, 4 Drawing Figures

OFFSET MOUTHPIECE STRUCTURE FOR UNDERWATER BREATHING

FIELD OF THE INVENTION

This invention relates to underwater breathing apparatus and more particularly it relates to underwater mouthpieces having members extending into the mouth for gripping between the teeth.

BACKGROUND OF THE INVENTION

Underwater breathing apparatus with special mouthpiece structure is well known. For example, snorkels having mouthpieces retained in the mouth are described in U.S. Pat. No. 3,814,090—June 4, 1974—J. E. Hill.

These mouthpieces may be separately made of a flexible material such as rubber or plastic to snap on or fit over corresponding snorkel tube or other underwater breathing equipment as shown in U.S. Pat. No. 4,031,888—June 28, 1977 to W. D. Walters.

This patent and U.S. Pat. No. 3,929,548—Dec. 30, 1975 to R. B. Shamlian provide for retaining members on the mouthpiece that may be gripped in the teeth.

It is customary in such mouthpieces as the Shamlian and Hill embodiments to have a flange about a breathing tube over which the lips are placed to form a seal with the breathing tube. This flange is in the form of a generally flexible planar curved surface that abuts the teeth between the lips and outer teeth surfaces. Prior art flanges receive the teeth in an unnatural and uncomfortable position with the lower jaw protruded out of its relaxed normal resident position. Since the retainer members over long periods of time must be gripped firmly by the teeth to prevent dislodging in the event of striking an object or in any emergency condition, it is critical that the mouthpiece can be comfortably held. For example, in cold water the grip becomes even more difficult. Also in some extreme cases the jaw might be damaged because of a prolonged or excessively unnatural firm bite with jaw bones unseated.

It is therefore an objective of this invention to overcome such prior art deficiencies.

DISCLOSURE OF THE INVENTION

Therefore in accordance with the present invention an underwater mouthpiece is provided with retainer members to be gripped by the teeth of a user with the jaws in a normal position. Thus the gripping position is one having the jaws in a comfortable and natural resident position with jaw bones seated. There is thus eliminated the requirement to unnaturally protrude the lower jaw.

This is achieved by special mouthpiece structure which offsets the flange against which the teeth abut to fit the lower and upper jaws in their natural position with a slight upper jaw overbite, so that the lower jaw need not be protruded to abut the flange. Thus an upper jaw flange portion is offset about 40 mm (¼ inch) away from the mouth from the lower jaw flange portion to accommodate an average normal overbite.

DESCRIPTION OF THE PREFERRED EMBODIMENT

Figure 1:
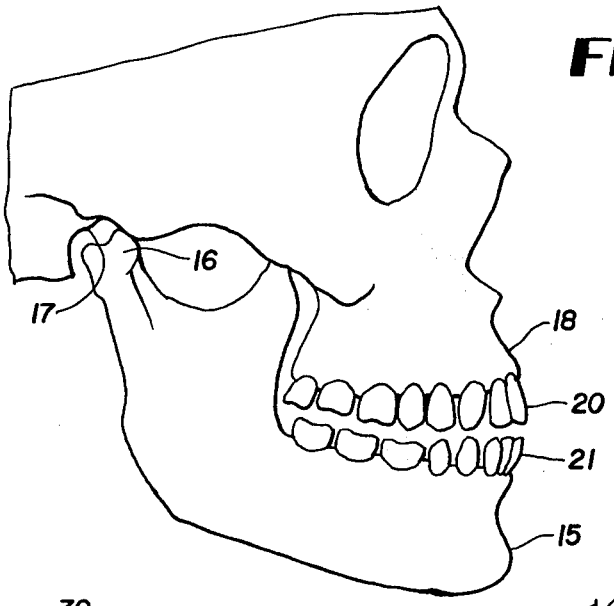
FIG. 1 is a profile side view sketch of the human oral arrangement of the upper and lower jaw bones and teeth shown with lower jaw bone protruded.

As may be seen in the sketch of FIG. 1, a lower jaw bone 15 (mandible) has a ball joint 16 (condyle) that fits into a socket 17 (glenoid fossa) of the upper jaw bone 18 (maxilla) and is held there in a way permitting limited movement (protrusion) of the lower jaw bone 15 out of the socket as held and controlled by muscular structure, not shown.

The normal position of this muscular structure and the lower jaw bone with the ball joint 16 seated into socket 17 (FIG. 4) gives a mating position of the molar teeth and allows a slight overbite of the front teeth normally in the order of about 40 mm (¼ inch). In the position shown, the muscles holding the ball 16 in socket 17 are extended and tend to be uncomfortable and fatigued after a long period of time, which is quite an unnatural condition. Also cold water temperatures on the cheeks can affect the muscular reaction and comfort.

The jaws 15, 18 as shown in FIG. 1 are in the unnatural position necessary to abut the front of the teeth with the generally planar flange on the prior art mouthpieces, that is with the upper front teeth 20 and lower front teeth 21 aligned to abut a planar object. This is the position that need be taken to bite down on the retention members in the mouthpieces of the prior art. Furthermore, the molars do not mate in bite down position for a firm natural grip.

Figure 2:
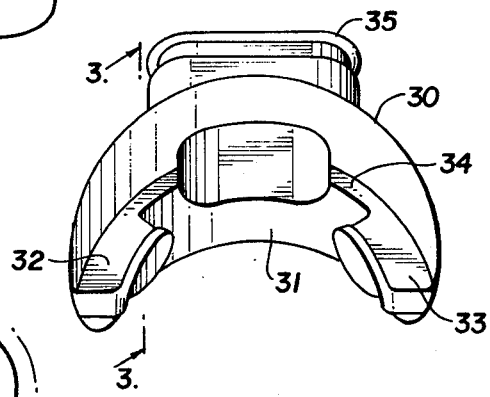
FIG. 2 is a top perspective view of the mouthpiece structure afforded by this invention.
Figure 3:
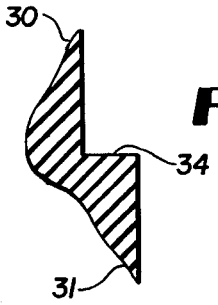
FIG. 3 is a section view along lines 3—3 of the mouthpiece structure of FIG. 2.
Figure 4:
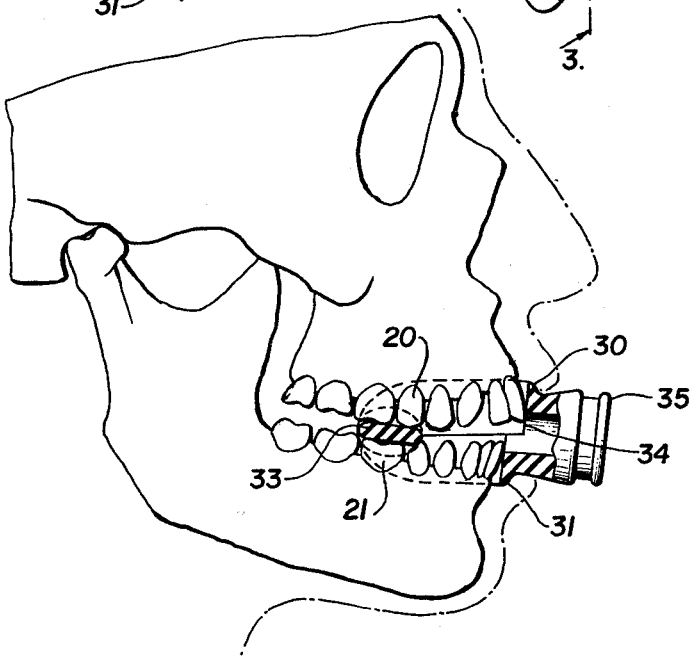
FIG. 4 is a profile side view sketch of the human teeth gripping a mouthpiece embodiment of the invention.

To correct this problem, the mouthpiece of this invention is constructed as shown in FIGS. 2 and 3 with offset upper 30 and lower 31 flange members that permit the grasping of the retention members 32, 33 between the molars in a normal mating bite position with the ball joint 16 of the lower jaw bone 15 seated into the socket 17, as shown in FIG. 4, and thus not introducing the discomfort and fatigue of abnormal positioning of the muscles and jaws when the lower jaw bone 15 is protruded. The ledge 34 lets the top teeth rest on the mouthpiece portion connecting the flange members 30, 31. Also the retainer lugs 33, etc. are gripped between the molars in natural mating position.

Thus, divers and underwater breathers can breathe in more comfort and with more safety with the novel structure of the offset upper and lower flange members provided by this invention.

Having thus advanced the state of the art, those novel features believed descriptive of the nature and spirit of the invention are defined with particularity in the appended claims.

What is claimed is:

1. In a mouthpiece for underwater breathing apparatus of the type held in place by biting down on a resilient tab held between the upper and lower teeth overcoming the problem of fatigue caused by the jaws being held in unnatural positions when biting down, the combination comprising, a breathing tube having one end axially disposed for insertion into the mouth for breathing, a U-shaped resilient flange having a bridging portion extending into opposite leg portions, said breathing tube having one end extending through said bridging portion and adapted for grasping by a user with lips about the breathing tube with the flange between the lips and the teeth of the user, to rest contiguous to the teeth of both the upper and lower jaws, integral retaining means extending inwardly from the leg portions of said flange to reside between the teeth for gripping by biting down thereupon to hold the mouthpiece in place, and said resilient flange having upper and lower flange members offset along the tube axis to terminate in offset upper and lower wall portions substantially perpendicular to the axis of the breathing tube with said upper wall portion for receiving the upper jaw teeth and said lower wall portion for receiving the lower jaw teeth contiguous thereto only on the outer teeth surfaces, said two walls being offset along the breathing tube axis with the upper wall portion offset an amount from the lower wall portion in a direction away from the leg portions of said flange for receiving the upper and lower jaw teeth respectively contiguous thereto, a flat ledge defined by an intersecting surface in said flange extending between said upper and lower wall portions in a plane substantially parallel to the longitudinal axis of said breathing tube, said retaining means having an upper surface substantially lying in the same plane as said flat ledge whereby the upper teeth will rest on the flat ledge defined by the offset flanges in natural jaw positions, said offset being approximately dimensioned by the normal jaw overbite distance thereby to permit the jaw to rest naturally in place when biting down on the retaining members without need to move the lower jaw into an unnatural position forward from the natural overbite position normal in the human anatomy, thereby to resolve the problem of discomfort and fatigue caused by gripping said retaining means between the teeth with the lower jaw forward from its natural position.

* * * * *